United States Patent [19]

COSPER

[11] 4,016,976

[45] Apr. 12, 1977

[54] A SUPPORT FOR STORING AND SHIPPING SMALL BOATS

[76] Inventor: Dale L. Cosper, 1603 Hoover Ave., South Bend, Ind. 46615

[22] Filed: June 10, 1976

[21] Appl. No.: 694,561

[52] U.S. Cl. ..... 206/521, 206/821; 229/14 C

[51] Int. Cl.[2] ..... B65D 85/68

[58] Field of Search ..... 206/335, 453, 521, 523, 206/821; 229/14 C; 248/154, 346, 350

[56] References Cited

UNITED STATES PATENTS

| | | | |
|---|---|---|---|
| 2,803,372 | 8/1957 | Lee | 206/521 XR |
| 3,946,917 | 3/1976 | Crawford et al. | 206/523 XR |

*Primary Examiner*—George T. Hall
*Attorney, Agent, or Firm*—Oltsch & Knoblock

[57] ABSTRACT

A support for a boat in which a pair of cradles adapted for resting upon the floor or ground are positioned on opposite sides of the boat and are drawn into engagement with the boat adjacent its gunwales by connectors, thereby enabling the boat to be supported vertically or horizontally.

4 Claims, 3 Drawing Figures

A SUPPORT FOR STORING AND SHIPPING SMALL BOATS

SUMMARY OF THE INVENTION

This invention relates to a support by which boats may be conveniently and compactly stored or shipped.

In this invention the boat support includes first and second cradle means which are positioned generally abeam the boat with one of the cradle means located at the starboard side and the other cradle means located at the portside of the boat adjacent the boat gunwales. Each cradle means includes a base means for supporting contact with the floor or ground and a trough means which makes contact with the boat. Connector means extend between the cradle means and urge the cradle means toward each other to clamp the boat between the cradle means. The cradle means are designed so as to enable the boat to be supported on its side or in a vertical position with other cradled boats being stacked thereon. Additionally, the boat may be laid in a horizontal position, whether upright or upsidedown, with the cradle means supporting the boat on the ground or floor.

Accordingly, it is an object of this invention to provide means for supporting a boat for storage or shipment in an economical manner.

Another object of this invention is to provide a device by which small boats may be supported in a compact manner for storage or shipment.

Still another object of this invention is to provide a device for supporting a boat in a vertical or horizontal position for storage or shipping purposes.

Other objects of this invention will become apparent upon a reading of the invention's description.

BRIEF DESCRIPTION OF THE DRAWINGS

A preferred embodiment of this invention has been chosen for purposes of illustration and description wherein.

DESCRIPTION OF THE PREFERRED EMBODIMENT

Figure 1:
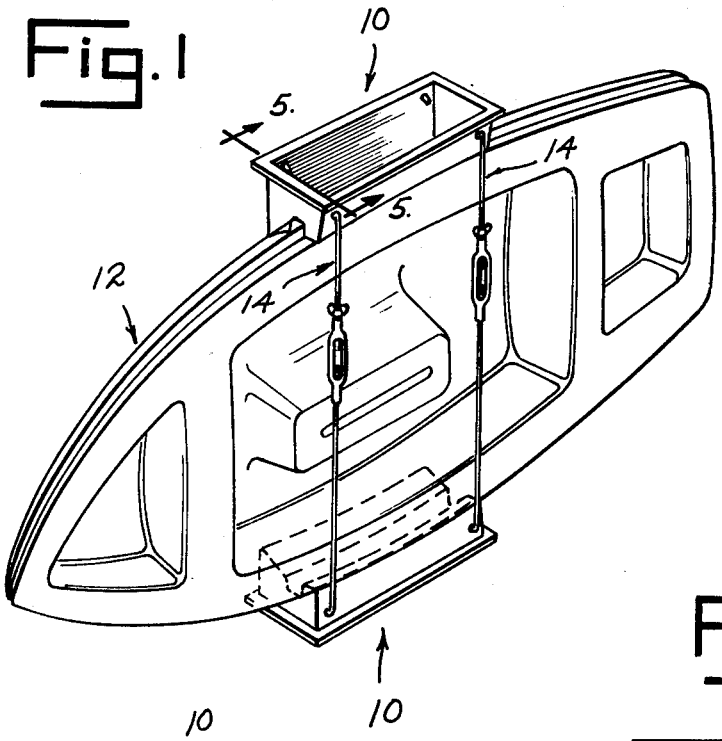
FIG. 1 is a perspective view of a cradled boat.
Figure 2:
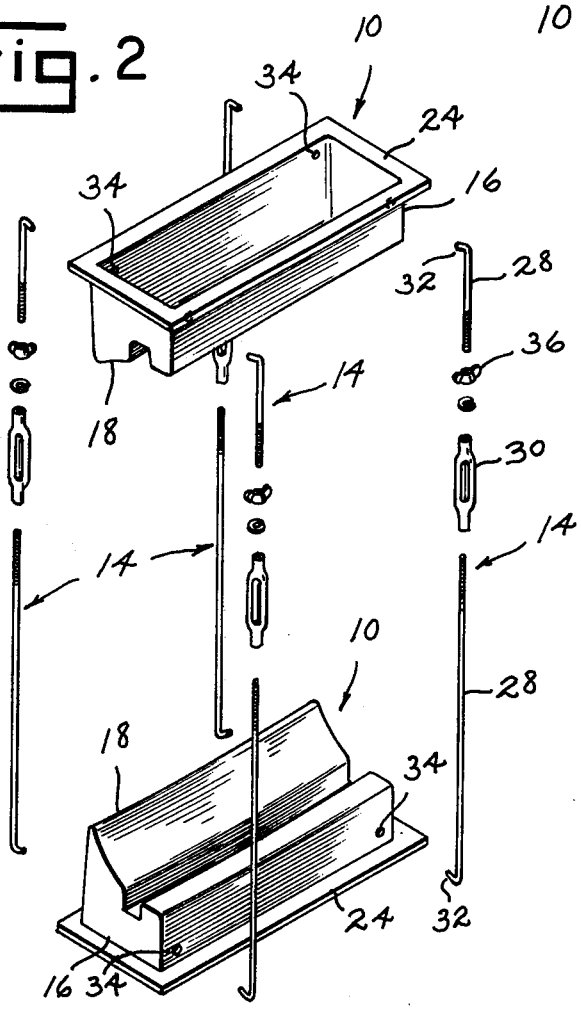
FIG. 2 is a perspective view of the component parts of the support shown in exploded form.
Figure 3:
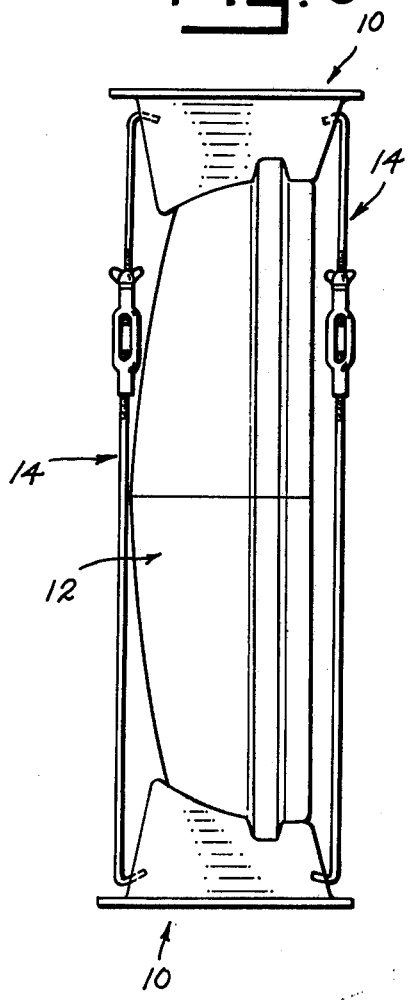
FIG. 3 is an end view of the cradled boat as seen from the bow.

The preferred embodiment illustrated is not intended to be exhaustive or to limit the invention to the precise form disclosed. It is chosen and described in order to best explain the principles of the invention and its application and practical use to thereby enable others skilled in the art to best utilize the invention.

In the illustrated embodiment the support device of this invention includes a pair of cradles 10 connected together to engage and clamp boat 12 therebetween by four elongated connectors 14. The cradles 10 are preferably of like construction with each cradle including a flanged base 16 and a trough part 18. Each cradle 10 may be formed of a variety of materials such as plastic, fiberglass, or metal.

Figure 6:
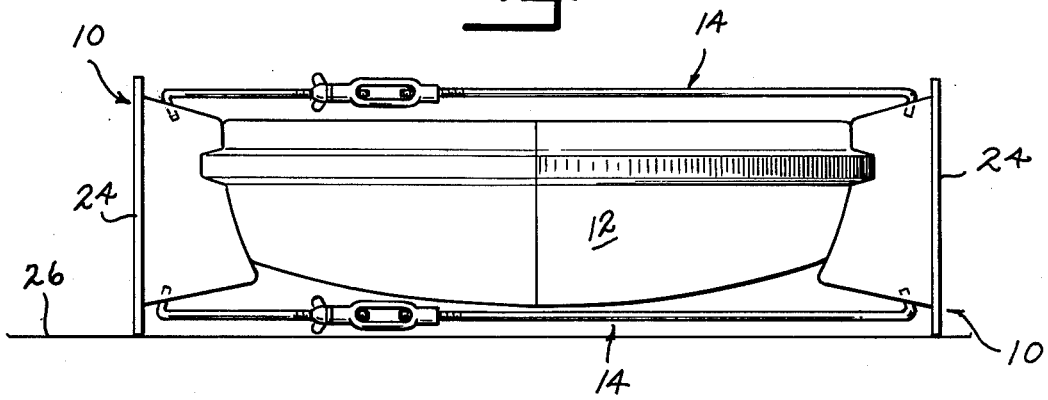
FIG. 6 is an end view of a cradled boat shown in an upright position from the bow.

In an actual construction each cradle 10 was formed from molded fiberglass, thereby providing excellent structural strength with a relatively light weight material. Trough part 18 of each cradle 10 is formed so as to extend from gunwale 20 along hull 22 of boat 12 abeam the boat at each of its port and starboard sides. Each cradle trough part 18 is molded to conform to the side of a particular boat so as to insure a secure fit between the cradles and boat when the cradles are drawn into contact with the boat by connectors 14. It is to be understood though that trough parts 18 of cradles 10 may be designed so as to have universal application to a variety of models and types of boats. Base 16 of each cradle 10 includes a peripheral flange 24 which extends about the four sides of the base. Flange 24 besides providing stability and strength to the cradle also permits the cradled boat to be stored horizontally as shown in FIG. 6 without connector 14 interferring with the underlying floor 26.

Each connector 14 which serves to connect cradles 10 includes threaded rod parts 28 connected by a turnbuckle 30. The free ends of rod parts 28 are bent into hooks 32. To accommodate connectors 14, each cradle 10 has a pair of openings 34 formed in each of its sides. Rod part hooks 32 are fitted into cradle openings 34 with the turnbuckles 30 of connector 14 being rotated so as to apply tension to the connected rod parts, thus drawing cradles 10 positioned on opposite sides of the boat toward one another, and thereby clamping boat 12 therebetween. Each connector 14 may be provided with a wing nut 36 which, after the cradles have been positioned about the boat and rod parts 28 tensioned, may be tightened against the turnbuckle to prevent it from loosening during storage or shipping of the boat. To provide extra reinforcement about cradle openings 34 in the case of a plastic or fiberglass cradle, a steel washer 38 may be molded or laminated into the cradle about each opening.

While each connector 14 is illustrated as two turnbuckle-connected rod parts, a cable, a rope, a strap or a spring could also be used to connect the cradles.

Figure 4:
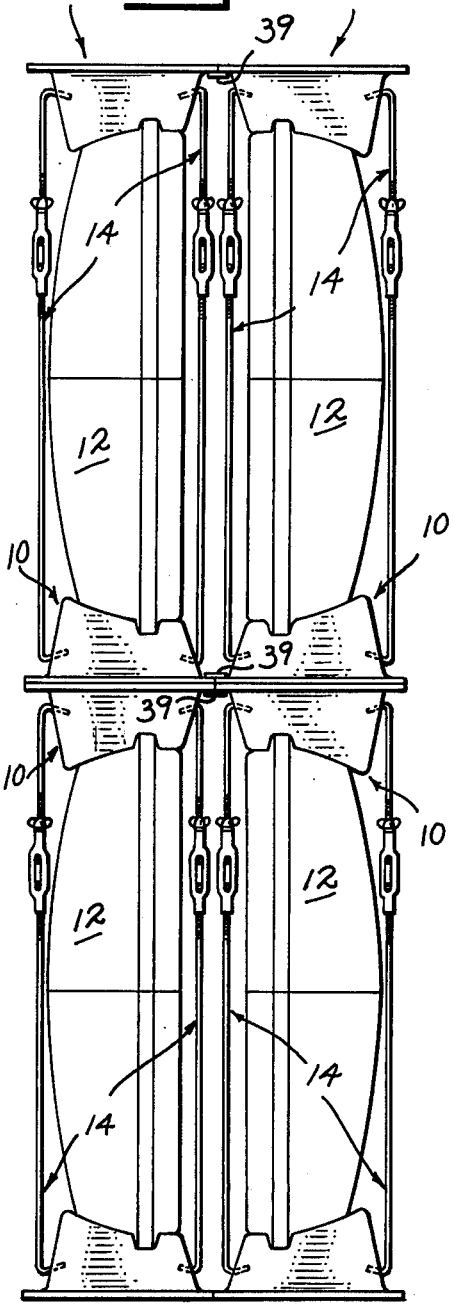
FIG. 4 is an end view of a series of cradled boats.
Figure 5:
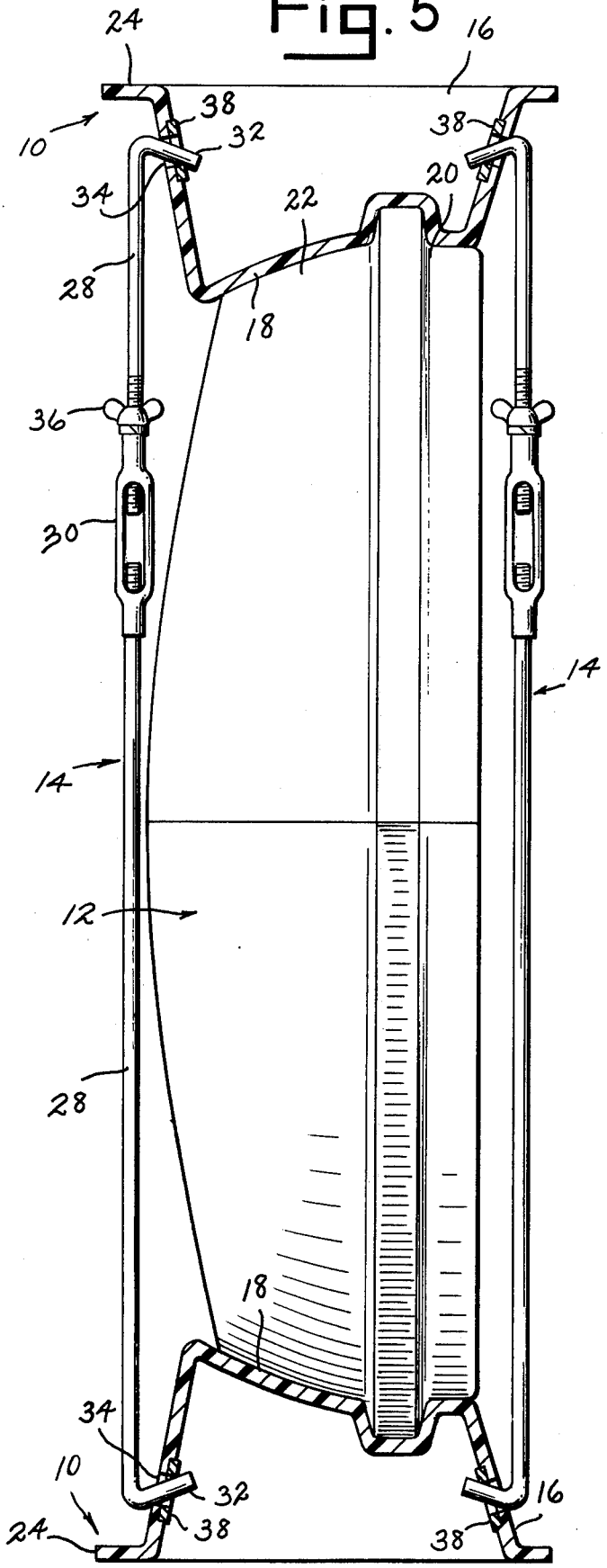
FIG. 5 is an sectional view as seen along line 5—5 of FIG. 1.
Figure 7:
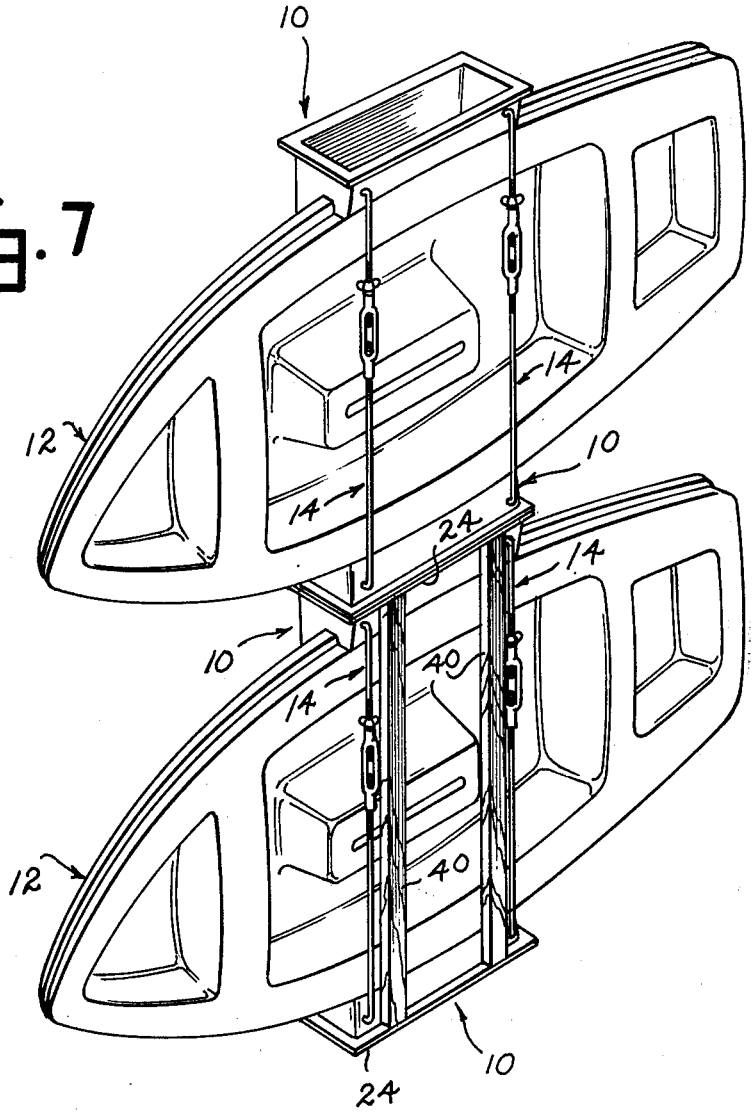
FIG. 7 is a perspective view of two stacked cradled boats.

In FIG. 4 a plurality of vertically orientated cradled boats 12 are shown stacked. Clips 39 may be attached to the flanges of adjacent cradles to provide lateral anchorage for the stacked boats. In FIG. 7 vertical supports 40 are shown extending between flanges 24 of cradles 10 supporting lower boat 12. Although not shown, there are two similar supports 40 extending between cradles 10 at the opposite side of the boat. Supports 40 prevent lower boats 12 from being subjected to excessive compressive forces from the weight of the upper boats.

In FIG. 6, a boat 12 is shown supported in a horizontal position. By redesigning base 16 and flange 24 thereabout, cradles 10 may be modified to accommodate the stacking of boats 12 in their horizontal positions.

It is to be understood the above described invention is not to be limited to the details above given but may be modified within the scope of the appended claims.

What I claim is:

1. A support for a boat comprising first and second cradle means for positioning generally abeam said boat with said first cradle means at the port side and said second cradle means at the starboard side of the boat, each cradle means including a base means for contact with the floor or ground and trough means for contacting said boat adjacent the gunwales thereof, and connector means extending between said first and second cradle means for urging said cradle means towards one another into compressive engagement with said boat.

2. The boat support of claim 1 wherein each cradle base means is for supporting said boat upon another said cradle base means.

3. The boat support of claim 1 wherein each cradle includes a first side for positioning along the hull and a second side for positioning above the gunwales of said boat, said connector means including at least two elongated connectors, one connector secured to and extending between the first sides of said cradle means and the other connector secured to and extending between the second sides of said cradle means.

4. The boat support of claim 3 wherein each connector includes means for tensioning the connector to draw said cradle means toward one another.

* * * * *